US012312799B2

(12) United States Patent
Kobayashi et al.

(10) Patent No.: US 12,312,799 B2
(45) Date of Patent: May 27, 2025

(54) MODULE FOR SEPARATE CONVEYANCE, STRUCTURE FOR PLANT, AND METHOD OF CONSTRUCTING STRUCTURE FOR PLANT

(71) Applicant: JGC CORPORATION, Kanagawa (JP)

(72) Inventors: Ken Kobayashi, Kanagawa (JP); Yohei Yamaki, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 285 days.

(21) Appl. No.: 17/630,165

(22) PCT Filed: Aug. 6, 2019

(86) PCT No.: PCT/JP2019/030913
§ 371 (c)(1),
(2) Date: Jan. 26, 2022

(87) PCT Pub. No.: WO2021/024382
PCT Pub. Date: Feb. 11, 2021

(65) Prior Publication Data

US 2022/0282474 A1 Sep. 8, 2022

(51) Int. Cl.
*E04B 1/348* (2006.01)
*E04B 1/24* (2006.01)

(52) U.S. Cl.
CPC ..... *E04B 1/3483* (2013.01); *E04B 1/2403* (2013.01); *E04B 2001/2415* (2013.01)

(58) Field of Classification Search
CPC ..... E04H 5/02; E04H 5/005; E04H 12/342; E04H 1/04; E04B 1/3483; E04B 1/34861;
(Continued)

(56) References Cited

U.S. PATENT DOCUMENTS 3,881,571 A * 5/1975 Moulton ..... E04G 1/14 182/178.5
5,412,913 A * 5/1995 Daniels ..... E04B 1/24 52/236.7

(Continued)

FOREIGN PATENT DOCUMENTS

AU 2013101343 A4 * 11/2013 ..... B66D 3/18
JP H07102637 4/1995
JP 2010275782 12/2010

OTHER PUBLICATIONS

"International Search Report (Form PCT/ISA/210) of PCT/JP2019/030913", mailed on Oct. 29, 2019, with English translation thereof, pp. 1-3.

(Continued)

*Primary Examiner* — Kyle J. Walraed-Sullivan
(74) *Attorney, Agent, or Firm* — JCIPRNET

(57) ABSTRACT

Provided are a module for separate conveyance, which is inexpensive and can easily be conveyed via any route, a structure for a plant, which uses the modules for separate conveyance, and a method of constructing the structure for a plant. A module for separate conveyance, to be conveyed in a separate manner and stacked at a construction site includes: column portions to be provided upright in a vertical direction; and a horizontal structural portion to be provided in a horizontal direction between the column portions. The horizontal structural portion directly separates tier spaces adjacent to each other in an up-and-down direction when the modules for separate conveyance are stacked.

10 Claims, 15 Drawing Sheets

(58) Field of Classification Search
CPC .... E04B 1/2403; E04B 1/343; E04B 1/34315; E04B 1/34331; E04B 1/34384; E04B 1/35; E04B 2001/2415; E04B 2001/2418; E04B 2001/3588; E04B 2001/2457; E04B 2001/246; E04B 2001/1975; E04B 2001/2448; E04B 2001/2451; E04B 2001/2454; E04B 2201/2457
See application file for complete search history.

(56) References Cited

U.S. PATENT DOCUMENTS

| | | | | |
|---|---|---|---|---|
| 6,829,872 | B2 * | 12/2004 | Wahlsteen | E04B 1/2403 403/337 |
| 8,769,886 | B2 * | 7/2014 | Ohnishi | E04B 1/3483 52/638 |
| 9,010,037 | B1 * | 4/2015 | Gonzalez | E04C 5/166 52/125.4 |
| 10,526,781 | B2 * | 1/2020 | Lestini | E04B 1/1912 |
| 10,907,342 | B1 * | 2/2021 | Parkhouse | E04B 1/388 |
| 2003/0167725 | A1 * | 9/2003 | Long | E04B 1/35 52/750 |
| 2003/0177732 | A1 * | 9/2003 | Wahlsteen | E04B 1/2403 52/655.1 |
| 2007/0094946 | A1 * | 5/2007 | Schoeny | E04H 5/02 52/79.1 |
| 2008/0060876 | A1 * | 3/2008 | Henderson | E04B 1/2403 182/186.8 |
| 2009/0300998 | A1 * | 12/2009 | Ablett | E04H 5/02 52/79.1 |
| 2011/0056147 | A1 * | 3/2011 | Beaudet | E04B 1/34869 52/79.9 |
| 2012/0279141 | A1 | 11/2012 | Wiederick et al. | |
| 2013/0055671 | A1 * | 3/2013 | Bruce | E04C 3/08 52/645 |
| 2014/0115976 | A1 * | 5/2014 | Lippert | E04H 1/005 52/79.2 |
| 2014/0137486 | A1 | 5/2014 | Driess | |
| 2014/0298745 | A1 * | 10/2014 | Rechenmacher | E04H 1/005 52/425 |
| 2015/0308096 | A1 * | 10/2015 | Merhi | E04G 21/14 52/745.1 |
| 2016/0017609 | A1 * | 1/2016 | Bottin | E04D 13/064 52/302.1 |
| 2017/0328055 | A1 * | 11/2017 | Morales | E04B 1/3483 |
| 2018/0058060 | A1 | 3/2018 | Anderson et al. | |
| 2018/0109163 | A1 * | 4/2018 | Paine | E04H 5/04 |
| 2018/0187444 | A1 * | 7/2018 | Klein | E04H 9/10 |
| 2018/0355600 | A1 * | 12/2018 | Yang | E04B 5/10 |
| 2019/0100934 | A1 * | 4/2019 | Ansari | E04H 5/02 |
| 2019/0257070 | A1 * | 8/2019 | Grosch | E04B 1/5831 |
| 2019/0376276 | A1 * | 12/2019 | Lucho Do Valle | E04B 1/34336 |
| 2020/0208395 | A1 * | 7/2020 | Hall | E04B 1/19 |
| 2021/0062495 | A1 * | 3/2021 | Ligeti | E04B 1/34861 |
| 2021/0277649 | A1 * | 9/2021 | Bowron | E04B 1/34331 |
| 2022/0049491 | A1 * | 2/2022 | Yoshitaka | E04B 1/2403 |
| 2022/0144598 | A1 * | 5/2022 | Churchill | B66C 11/00 |
| 2022/0205235 | A1 * | 6/2022 | Chapman | E04B 1/165 |
| 2022/0251829 | A1 * | 8/2022 | Pospisil | B32B 13/04 |
| 2022/0364354 | A1 * | 11/2022 | Rafezy | E04B 1/3483 |
| 2023/0103008 | A1 * | 3/2023 | Kang | E04B 1/3483 52/79.5 |
| 2023/0121784 | A1 * | 4/2023 | Del Rio | E04B 1/3483 52/215 |
| 2023/0145279 | A1 * | 5/2023 | Snorrason | E04B 1/34861 52/79.1 |
| 2023/0272612 | A1 * | 8/2023 | Pospisil | E04B 1/24 52/270 |

OTHER PUBLICATIONS

"Office Action of Saudi Arabia Counterpart Application", issued on Feb. 28, 2023, with English translation thereof, p. 1-p. 6.

* cited by examiner (a)

(b)

(a)

(b)

(a)

(b)

MODULE FOR SEPARATE CONVEYANCE, STRUCTURE FOR PLANT, AND METHOD OF CONSTRUCTING STRUCTURE FOR PLANT

CROSS-REFERENCE TO RELATED APPLICATION

This application is a 371 application of the International PCT application serial no. PCT/JP2019/030913, filed on Aug. 6, 2019. The entirety of the above-mentioned patent application is hereby incorporated by reference herein and made a part of this specification.

TECHNICAL FIELD

The present invention relates to a module for separate conveyance, to be conveyed in a separate manner so as to construct, for example, a structure for a plant such as a petroleum refinery processing plant, a structure for a plant, to be constructed by stacking the modules for separate conveyance, and a method of constructing the structure for a plant.

BACKGROUND ART

There has hitherto been known a box-type module structure to be used for construction of a plant. The box-type module structure is formed into a box-like shape with use of horizontal frames and vertical frames, each being formed of an H-shaped steel member (see, for example, Patent Literature 1). The module structures, each having been assembled in advance as described above, are conveyed to a site and assembled together. As a result, a construction period for the plant can be shortened.

The module structure described above can be applied to various plants. For example, when the module structures are used for a petroleum refinery processing plant, a structure 102 for a plant can be constructed by stacking module structures 106, as illustrated in FIG. 15.

CITATION LIST

Patent Literature

[PTL 1] JP 2010-275782 A

SUMMARY OF INVENTION

Technical Problem

Petroleum refinery processing plants are constructed around the world. Thus, conditions for conveyance of the module structures 106 are different. For example, when a petroleum refinery processing plant is constructed in a country A, the module structures 106 are loaded in a container vessel and transported by a river. Further, the module structures 106 are reloaded on transport means such as a truck and transported on a highway to be conveyed to a site. In this case, for the transport by a river, it is required that a height of each of the module structures 106 be limited so that the module structures 106 are prevented from being brought into contact with a bridge.

Further, in a country B, the module structures 106, which have been unloaded from a container vessel at a port and reloaded on transport means such as a truck, are transported by land to a yard at a construction site for the petroleum refinery processing plant. In this case, when the module structures 106 are required to pass under a plurality of cables laid between steel towers on a land transport route, it is required that a height of each of the module structures 106 be limited in accordance with a height of the cables.

Further, in a case in which the structure 102 for a plant is a steel-framed structure, when a box type shape in which each of the module structures 106 has one tier space 112 is employed, a large number of steel frames are required. As a result, there arises a problem of an increase in manufacturing cost.

The present invention has an object to provide a module for separate conveyance, which is inexpensive and can easily be conveyed via any route, a structure for a plant, which uses the modules for separate conveyance, and a method of constructing the structure for a plant.

Solution to Problem

The present invention provides a module for separate conveyance, to be conveyed in a separate manner and stacked at a construction site, the module for separate conveyance including: column portions to be provided upright in a vertical direction; and a horizontal structural portion to be provided in a horizontal direction between the column portions, wherein the horizontal structural portion directly separates tier spaces adjacent to each other in an up-and-down direction when the modules for separate conveyance are stacked.

As a result, a total height of the modules for separate conveyance is reduced, and a total weight can be reduced. Thus, the module for separate conveyance, which is inexpensive and can easily be conveyed via any route, can be provided.

Further, in the module for separate conveyance according to the present invention, at least one of an upper end and a lower end of each of the column portions is a free end that is not joined to the horizontal structural portion, and a height position of the free end is apart from a height position of a boundary between the tier spaces.

As a result, a structural member, which has been required in a related-art box-type module, can be omitted, and hence the number of steel frames can be reduced. Thus, manufacturing cost can be suppressed.

Further, in the module for separate conveyance according to the present invention, the module for separate conveyance, which is to be arranged in a lowermost tier when the modules for separate conveyance are stacked, lacks base columns projecting downward beyond the horizontal structural portion located on a lowermost side.

As a result, the module for separate conveyance can be reduced in size, and a center of gravity at the time of conveyance can be set low.

Further, in the module for separate conveyance according to the present invention, a maximum height of the module for separate conveyance under a state in which a device is installed falls within a range of from 3 m or more to 20 m or less at time of conveyance.

With the suppression of a total height of the module for separate conveyance as described above, a weight of the module for separate conveyance can be reduced, and hence easy conveyance can be achieved.

According to the present invention, there is provided a structure for a plant, to be constructed by stacking the modules for separate conveyance described above, wherein a maximum height of the structure for a plant under a state in which devices are installed falls within a range of from 5 m or more to 25 m or less.

Specifically, with the suppression of a total height of the modules for separate conveyance, the structure for a plant, which is reduced in size as described above, can be achieved.

Further, in the structure for a plant according to the present invention, a horizontal plate is provided to each end of each of the column portions, and the ends of the upper and lower column portions are joined to each other in the up-and-down direction by connecting the horizontal plates to each other with use of high-strength bolts.

As described above, through the joining with use of the high-strength bolts, assembly work for the modules for separate conveyance at the site can be minimized, and hence safety and a working speed can be improved.

Further, in the structure for a plant according to the present invention, a splice plate is arranged over a joint between the ends of the upper and lower column portions so as to partially cover upper and lower flange portions, and the flange portions and the splice plate are joined to each other through connection with use of high-strength bolts.

As a result, the joining can be achieved so that a moment is precisely transmitted through a joint between the modules for separate conveyance.

According to the present invention, there is provided a method of constructing the structure for a plant described above, including: a mounting step of mounting lifting components to upper ends of the column portions; and an installation step of installing the module for separate conveyance while simultaneously lifting up all the column portions through intermediation of the lifting components.

As described above, with employment of the method of mounting the lifting components and lifting up the module for separate conveyance, a working speed of the work of lifting up the modules for separate conveyance can be improved. Further, with the simultaneous lift-up of all the column portions, balance can be prevented from being lost, for example, the module for separate conveyance can be prevented from being deformed.

Further, the method of constructing the structure for a plant according to the present invention further includes: a base-column upright installation step of installing base columns upright in a vertical direction on foundations; and a brace mounting step of mounting base portion braces in a crossing pattern between the base columns.

As a result, the module for separate conveyance in a lowermost tier is not provided with the base columns. Thus, a total height of the module for separate conveyance in the lowermost tier can be suppressed. Further, with the mounting of the base portion braces between the base columns, a resistance against a horizontal load can be improved.

Advantageous Effects of Invention

According to the present invention, the module for separate conveyance, which is inexpensive and can easily be conveyed via any route, the structure for a plant, which uses the modules for separate conveyance, and the method of constructing the structure for a plant can be provided.

DESCRIPTION OF EMBODIMENTS

Figure 1:
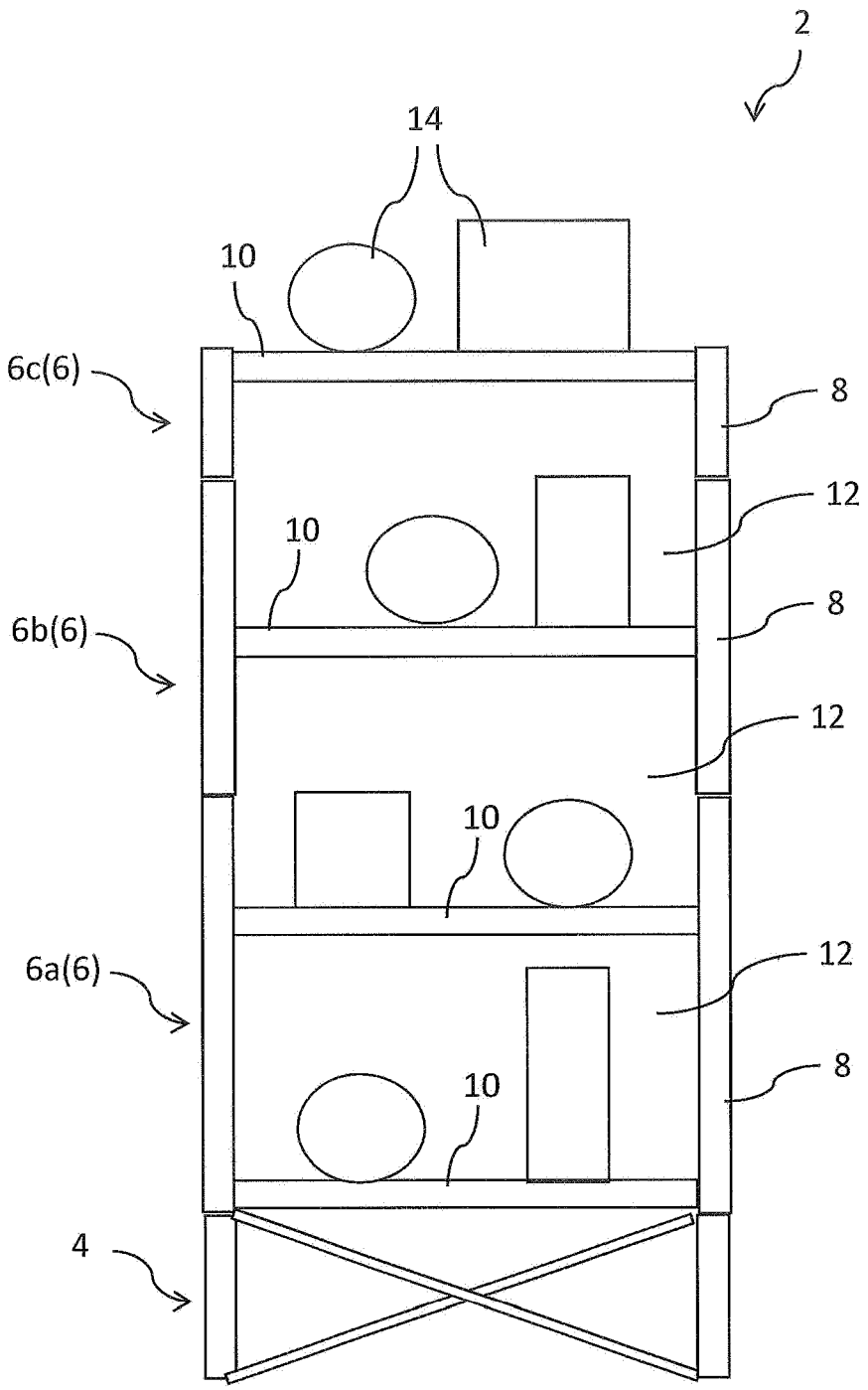
FIG. 1 is a view for illustrating an outline of a structure for a plant according to an embodiment of the present invention.

Now, a module for separate conveyance according to an embodiment of the present invention is described with reference to the drawings. FIG. 1 is a view for illustrating an outline of a structure for a plant according to the embodiment. As illustrated in FIG. 1, a structure 2 for a plant is constructed by stacking a plurality of modules 6 for separate conveyance on a base portion 4. The modules 6 for separate conveyance include a plurality of kinds of modules, specifically, a first module 6*a* for separate conveyance, a second module 6*b* for separate conveyance, and a third module 6*c* for separate conveyance. In FIG. 1, only one frame that forms one surface of the structure 2 for a plant in a span direction of the structure 2 for a plant is illustrated. In practice, a plurality of the frames illustrated in FIG. 1 are arranged continuously in a depth direction of FIG. 1.

Figure 2:
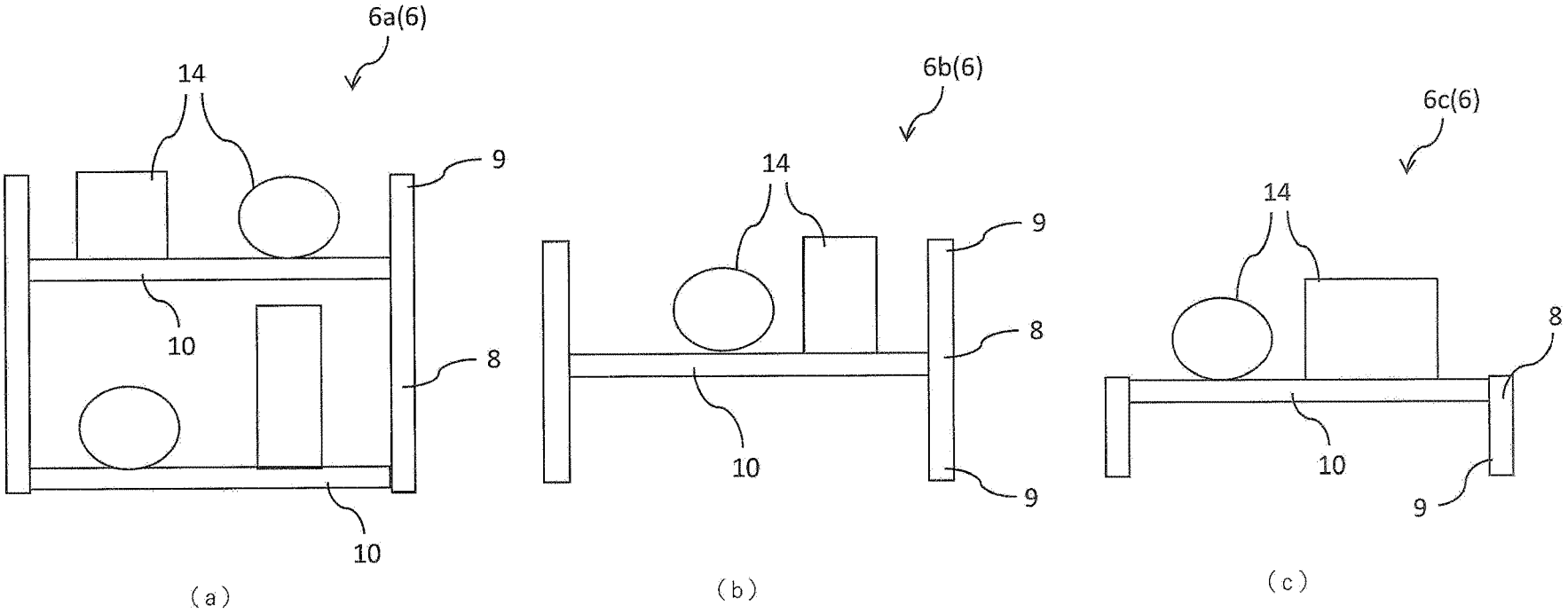
FIG. 2 are views for illustrating a state in which modules for separate conveyance included in the structure for a plant according to the embodiment are separated.

FIG. 2 are views for illustrating a state in which the modules 6 for separate conveyance included in the structure 2 for a plant are separated. The modules 6 for separate conveyance are conveyed in a separate manner as illustrated in FIG. 2, and are stacked at a construction site. Each of the modules 6 for separate conveyance includes column portions 8 and a horizontal structural portion 10. The column portions 8 are provided upright in a vertical direction. The horizontal structural portion 10 is provided in a horizontal direction between the column portions 8. On top of the column portions 8, devices 14 are installed. In this case, a maximum height of each of the modules 6 for separate conveyance under a state in which the devices 14 are installed falls within a range of from 3 m or more to 20 m or less.

In the structure 2 for a plant, in which the modules 6 for separate conveyance are stacked, as illustrated in FIG. 1, tier spaces 12 are formed as spaces, each being surrounded by the column portions 8 and the horizontal structural portion 10, and tiers are defined by the tier spaces 12. A height of the structure 2 for a plant under a state in which the devices 14 are installed falls within a range of from 5 m or more to 25 m or less.

Figure 15:
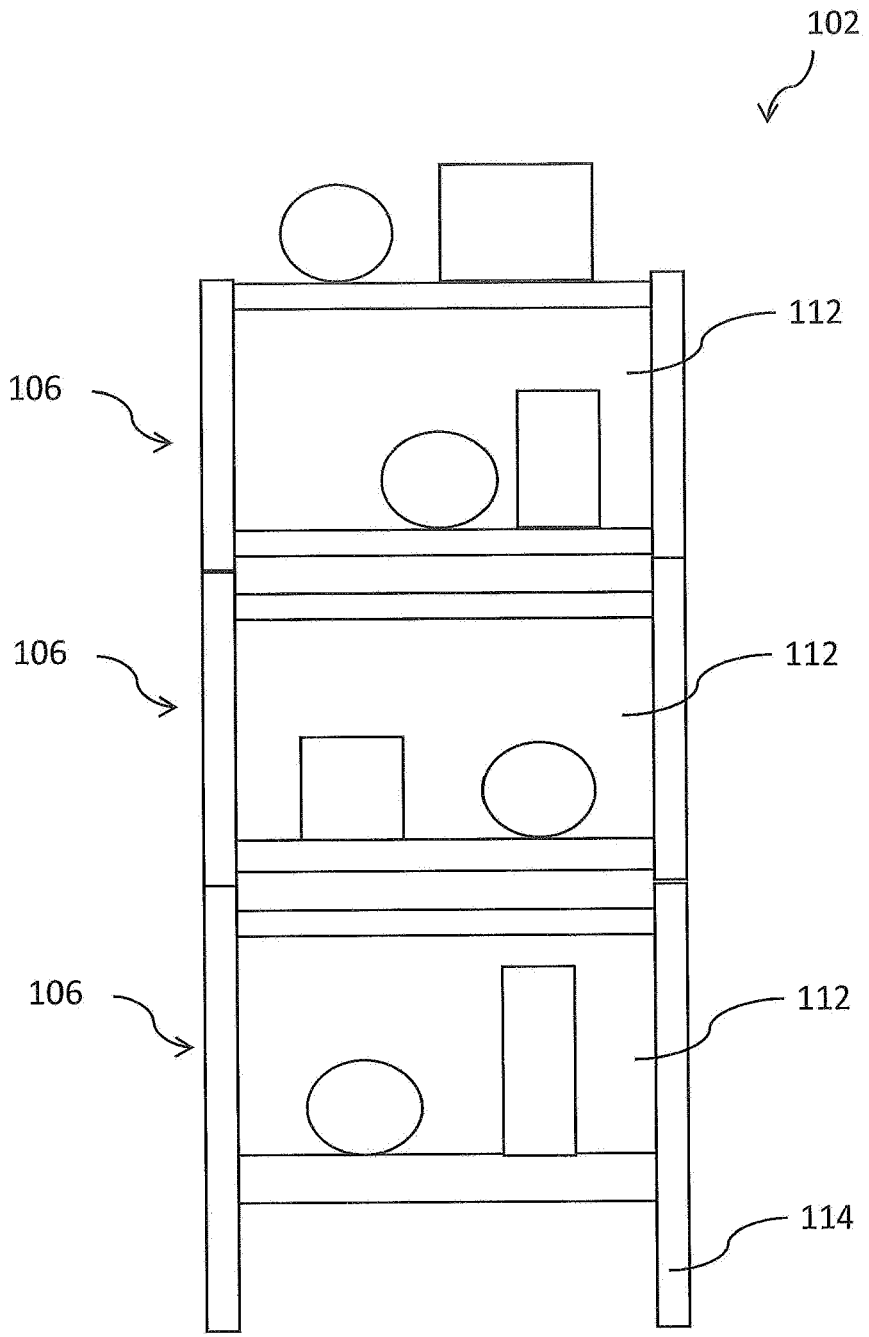
FIG. 15 is a view for illustrating a related-art structure for a plant.

In this case, for each of the modules 6 for separate conveyance, such a box type shape in which each module structure forms one tier space 112 as in the case of the module structures 106 illustrated in FIG. 15 is not employed. Instead, as illustrated in FIG. 1, the horizontal structural portion 10 directly separates the tier spaces 12 adjacent to each other in an up-and-down direction at the time of stacking. In the direct separation with the horizontal structural portions 10, a space formed by the base portion 4 in the first module 6*a* for separate conveyance and a space above the third module 6*c* for separate conveyance are also considered as the tier spaces 12.

At least one of an upper end and a lower end of each of the column portions 8 forms a free end 9 that is not joined to the horizontal structural portion 10. More specifically, in the first module 6*a* for separate conveyance, the lower ends of the column portions 8 are rigidly joined to the horizontal structural portion 10. The upper ends of the column portions 8 project upward beyond the horizontal structural portion 10, and each forms the free end 9. Further, in the second module 6*b* for separate conveyance, the horizontal structural portion 10 is located in the vicinity of a center of the second module 6*b* for separate conveyance in the up-and-down direction. Each of the upper end and the lower end of each of the column portions 8 forms the free end 9. Further, in the third module 6*c* for separate conveyance, the upper ends of the column portions 8 are rigidly joined to the horizontal structural portion 10. The lower ends of the column portions 8 project downward beyond the horizontal structural portion 10, and each forms the free end 9.

In any of the first module 6*a* for separate conveyance, the second module 6*b* for separate conveyance, and the third module 6*c* for separate conveyance when being in a stacked state, height positions of the free ends 9 are apart from a height position of a boundary between the tier spaces 12. More specifically, joint portions between the column portions 8 of the first module 6*a* for separate conveyance and the column portions 8 of the second module 6*b* for separate conveyance are located in the vicinity of a center of the tier space 12 of a second tier, and joint portions between the column portions 8 of the second module 6*b* for separate conveyance and the column portions 8 of the third module 6*c* for separate conveyance are located in the vicinity of a center of the tier space 12 of a third tier.

Further, in the structure 2 for a plant according to the embodiment, the first module 6*a* for separate conveyance, which is arranged in a lowermost tier when stacked, lacks base columns projecting downward beyond the horizontal structural portion 10 located on the lower side. Specifically, the base portion 4 is not included in the modules 6 for separate conveyance. This configuration contrasts with that of the structure 102 for a plant illustrated in FIG. 15, in which base columns 114 of the module structure 106 in a lowermost tier project. Thus, in the structure 2 for a plant according to the embodiment, the base portion 4 is assembled at a site as described later. The first module 6*a* for separate conveyance lacks base columns projecting downward beyond the horizontal structural portion 10 located on the lower side. Thus, the first module 6*a* for separate conveyance can be reduced in size, and hence a center of gravity at the time of conveyance can be set low.

Next, a method of constructing the structure 2 for a plant according to the embodiment is described. A conveyance route is described below taking the conveyance route for the country B, which has been described in "Technical Problem", as an example. First, each of the modules 6 for separate conveyance is assembled in advance in a steel frame processing factory, and is carried into a container vessel under a state in which the devices 14 are installed thereon. Then, after being unloaded at a port, the modules 6 for separate conveyance are loaded on transport means (not shown) such as a truck.

Next, the first module 6*a* for separate conveyance, the second module 6*b* for separate conveyance, and the third module 6*c* for separate conveyance, which are loaded on the transport means such as a truck, are transported by land to a construction site for the structure 2 for a plant for a petroleum refinery processing plant. On the land transport route, the modules 6 for separate conveyance, which have been loaded on the transport means such as a truck, are required to pass under a plurality of cables laid between steel towers. Each of the modules 6 for separate conveyance is manufactured so that a height of each of the modules 6 for separate conveyance under a state in which the devices 14 are installed thereon is limited to fall within a range of from 3 m or more to 20 m or less. Thus, the modules 6 for separate conveyance are not caught by the cables.

The modules 6 for separate conveyance, which are transported by land by the transport means such as a truck, are unloaded on a yard 19 (see FIG. 4) set up in the vicinity of the construction site for the structure 2 for a plant. In this case, foundations 20 are arranged in advance at the construction site for the structure 2 for a plant. Base columns 4*a* are installed upright on the foundations 20 (base-column upright installation step).

Figure 3:
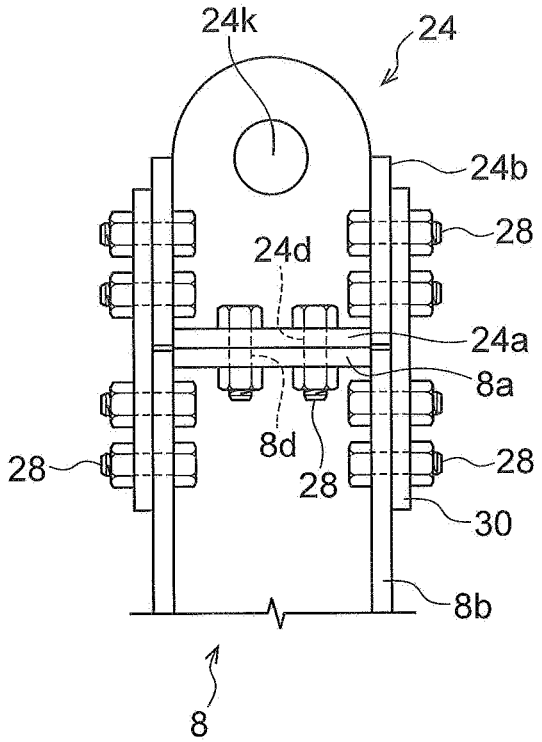
FIG. 3 are views relating to a lifting component to be used when the module for separate conveyance according to the embodiment is lifted up by a heavy machine.
Figure 3:
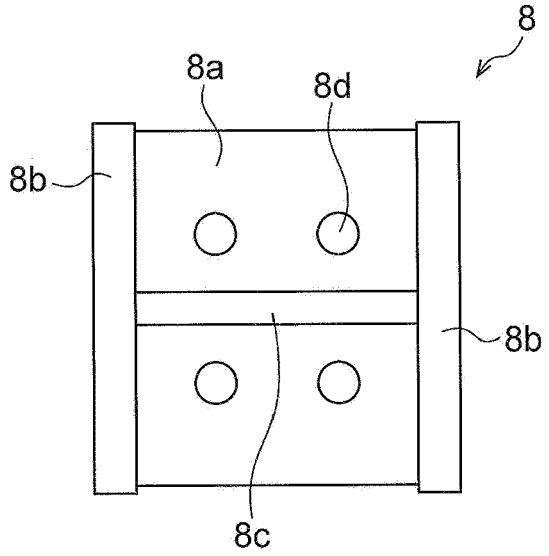

Next, a lifting component 24 is mounted to an upper end of each of the column portions 8 of the first module 6*a* for separate conveyance, which is to be first lifted up, as illustrated in FIG. 3(*a*) (mounting step). In this case, each of the column portions 8 is formed of an H-shaped steel member. A horizontal plate 8*a* is fixed to an upper end of the column portion 8. FIG. 3(*b*) is a sectional view of the column portion 8 when viewed from below. In a region of the horizontal plate 8*a*, which is located between flanges 8*b*, bolt holes 8*d* are formed so as to be positioned through a web 8*c* therebetween. Similarly, a horizontal plate 24*a* having bolt holes 24*d* is fixed to a lower side of the lifting component 24.

When the lifting component 24 is mounted to the column portion 8, the horizontal plate 24*a* of the lifting component 24 is first placed on the horizontal plate 8*a* for the column portion 8 while positions of the bolt holes 24*a* and 8*d* are aligned with each other. Next, as illustrated in FIG. 3(*a*), the horizontal plates 24*a* and 8*a* are connected to each other with use of high-strength bolts 28. Further, a splice plate 30 is arranged so as to partially cover a flange 24*b* of the lifting component 24 and the flange 8*b* of the column portion 8. In this case, bolt holes are formed in each of the flanges 24*b* of the lifting components 24, the flanges 8*b* of the column portion 8, and the splice plates 30. The splice plate 30 is arranged so that positions of the bolt holes formed therein are aligned with positions of the bolt holes formed in the flanges 24*b* and 8*b*. Next, the flanges 24*b* and 8*b* and the splice plate 30 are connected to each other with use of the high-strength bolts 28. The above-mentioned work is repeated for the upper ends of all the column portions 8 of the first module 6*a* for separate conveyance.

Figure 4:
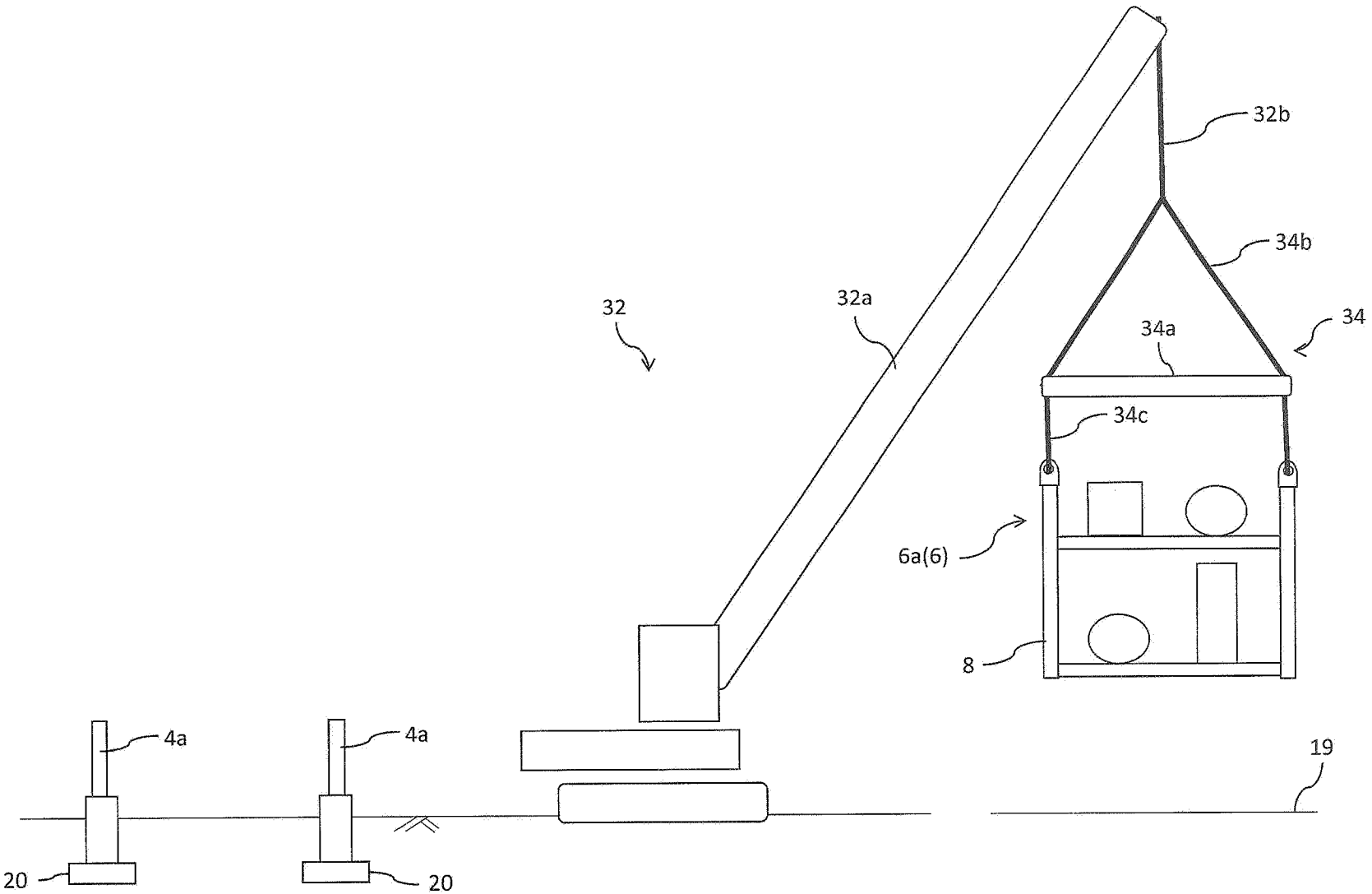
FIG. 4 is a view for illustrating a situation in which the module for separate conveyance according to the embodiment is lifted up by the heavy machine.

Next, as illustrated in FIG. 4, a heavy machine 32 is arranged at the construction site for the structure 2 for a plant. A wire 32*b* is hung from a distal end of an arm 32*a* of the heavy machine 32. A spreader beam 34 is suspended from a lower part of the wire 32*b*. Suspension wires 34*b* configured to suspend a beam main body 34*a* and holder wires 34*c* to be suspended from both ends of the beam main body 34*a* are connected to the spreader beam 34.

Next, a hook (not shown), which is provided to a lower end of each of the holder wires 34*c*, is inserted into a hole portion 24*k* of each of the lifting components 24 mounted to the first module 6*a* for separate conveyance, which is placed on the yard 19. Then, all the lifting components 24 are lifted up at the same time. The first module 6*a* for separate conveyance has an unstable structure in which the upper ends of the column portions 8 are formed as the free ends 9. However, when all the lifting components 24 are lifted up at the same time, balance of the first module 6*a* for separate conveyance can be prevented from being lost, for example, the first module 6*a* for separate conveyance can be prevented from being deformed. When the first module 6*a* for separate conveyance is lifted up, the spreader beam 34 is used, and hence the lifting components 24 can be pulled up in a perpendicular direction through the suspension wires 34*b*. Thus, a force in a direction toward a center of the first module 6*a* for separate conveyance acts on the column portions 8. Hence, inclination of the column portions 8 can be prevented.

Figure 5:
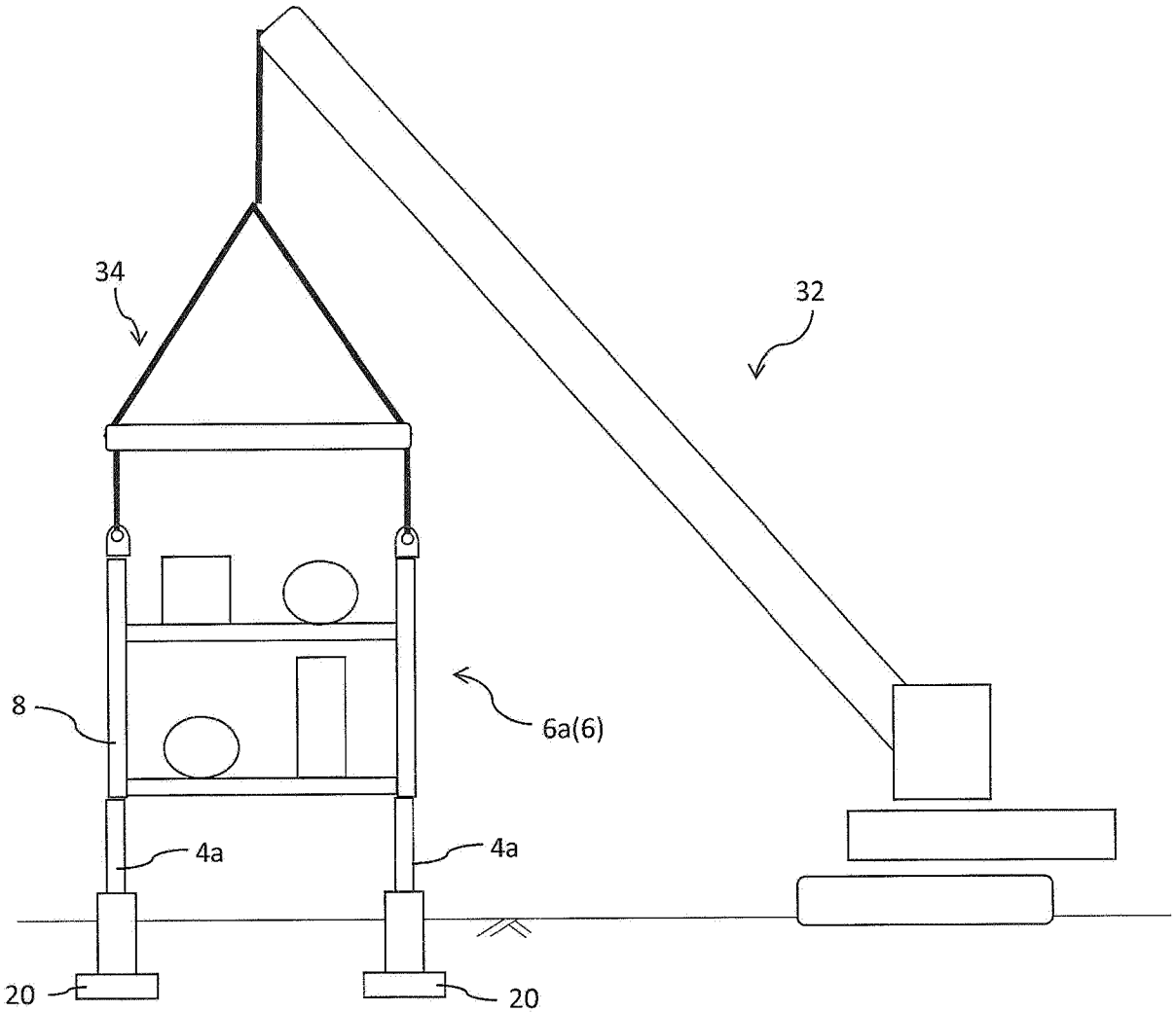
FIG. 5 is a view for illustrating a situation in which the module for separate conveyance according to the embodiment is stacked.
Figure 6:
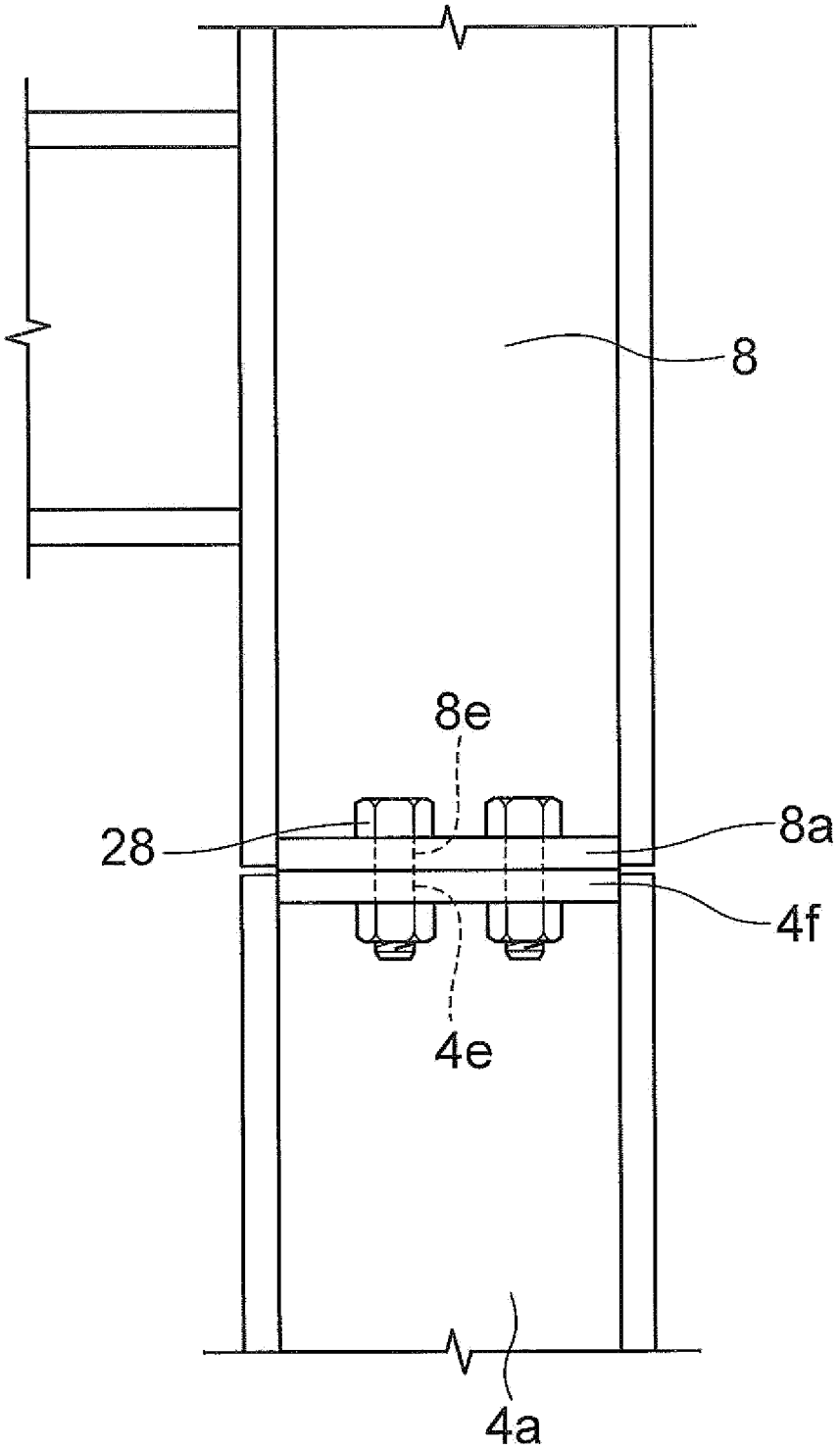
FIG. 6 is a view for illustrating a joint portion between a base column and an upper column portion in the structure for a plant according to the embodiment.

Next, the first module 6*a* for separate conveyance is installed on the base columns 4*a* under a state in which all the lifting components 24 are simultaneously lifted up (installation step). In the above-mentioned step, the arm 32*a* is moved to a position above the base columns 4*a* under a state in which the first module 6*a* for separate conveyance is suspended. As illustrated in FIG. 5, positions of the lower ends of all the column portions 8 included in the first module 6*a* for separate conveyance are aligned with positions of the base columns 4*a*. In this case, as in the case described above, a horizontal plate 4*f* having bolt holes 4*e* is fixed to an upper end of each of the base columns 4*a* (see FIG. 6). The horizontal plate 8*a* having bolt holes 8*e* is fixed to the upper end of the column portion 8. Thus, when the first module 6*a* for separate conveyance is mounted onto the base columns 4*a*, the horizontal plate 8*a* for the column portion 8 is first placed on the horizontal plate 4*f* for the base column 4*a* while positions of the bolt holes 4*e* and positions of the bolt holes 8*e* are aligned with each other as illustrated in FIG. 6. After that, the horizontal plate 4*f* and the horizontal plate 8*f* are connected to each other with use of the high-strength bolts 28. When braces 36 or compressive braces 36' cannot be mounted to the base columns 4*a*, the splice plate 30 may be arranged over a joint between the base column 4*a* and the column portion 8, and may be tightened with use of the high-strength bolts 28 to form a rigid joint (see FIG. 11).

Figure 7:
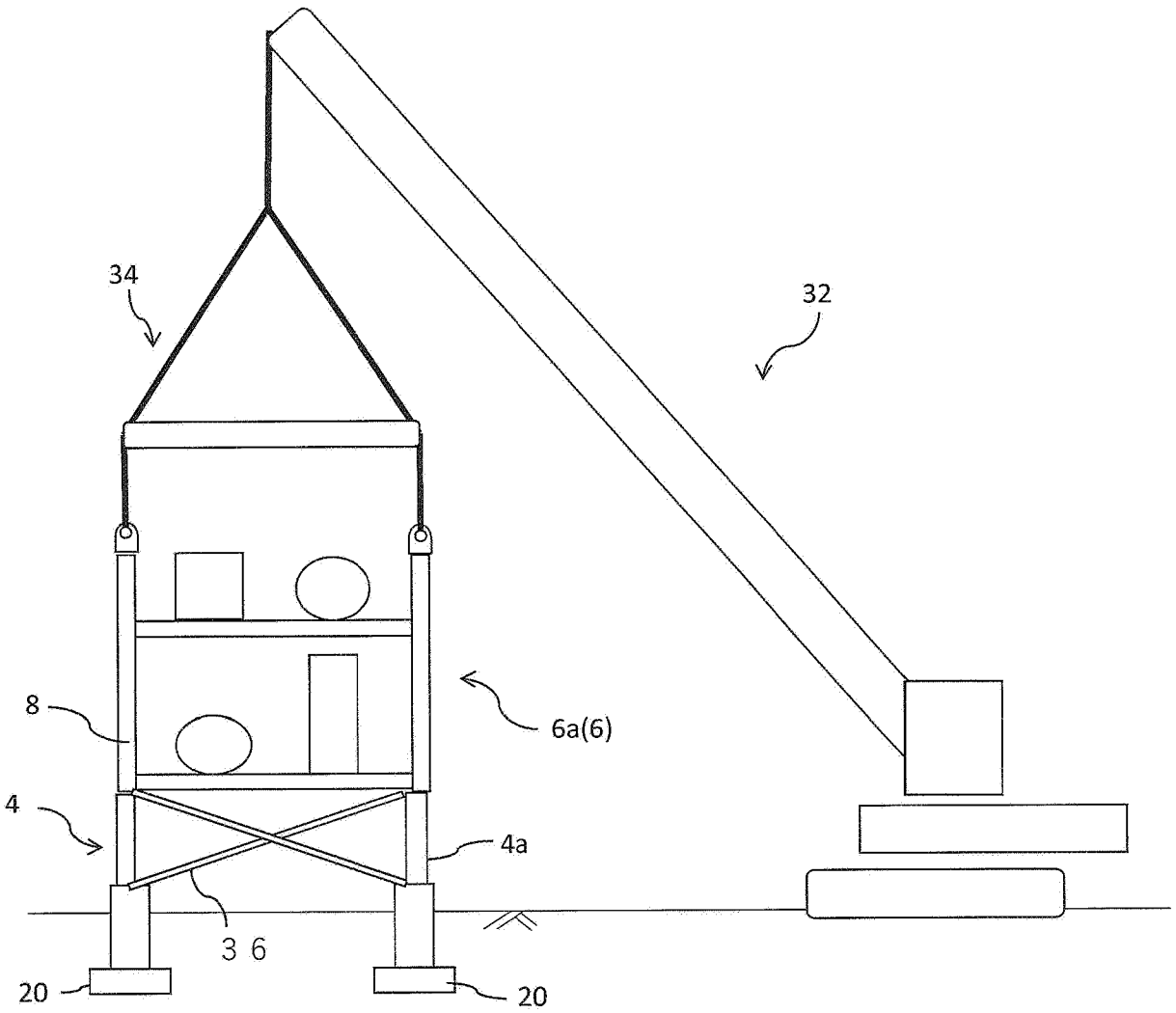
FIG. 7 is a view for illustrating a situation in which braces are installed between the base columns in a process of constructing the structure for a plant according to the embodiment.
Figure 8:
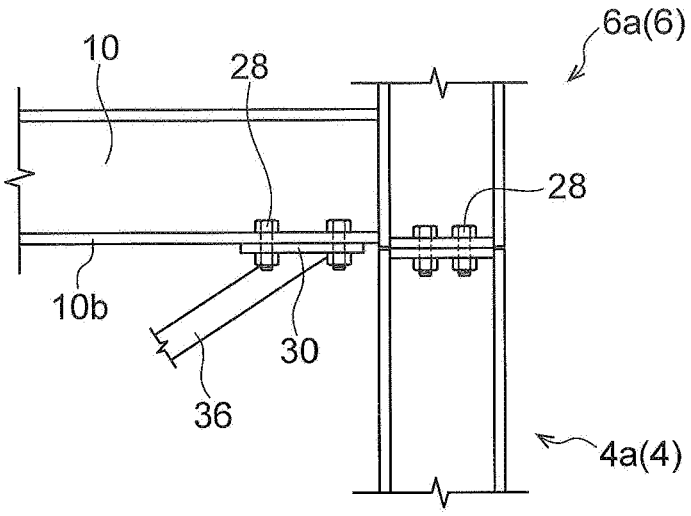
FIG. 8 are views, each for illustrating a joint portion of each type of brace in the structure for a plant according to the embodiment.
Figure 8:
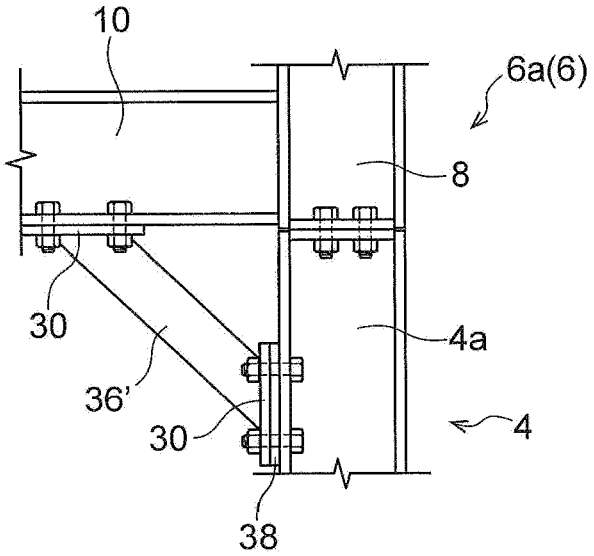

Next, as illustrated in FIG. 7, the braces 36 are provided between the base columns 4*a* so as to cross each other in an X-like pattern (brace mounting step) to form the base portion 4. In this case, an upper end of each of the braces 36 is connected to a flange 10*b* of the horizontal structural portion 10 through the splice plate 30 therebetween with use of the high-strength bolts 28, as illustrated in FIG. 8(*a*). It is not always required that the braces 36 be arranged in the X-like pattern. The compressive braces 36' may be used as illustrated in FIG. 8(*b*). In this case, on the base column 4*a* side, a filler plate 38 is further arranged between a flange of the base column 4*a* and the splice plate 30. With the arrangement of the filler plate 38 as described above, a position can be adjusted to absorb a manufacturing error.

Figure 9:
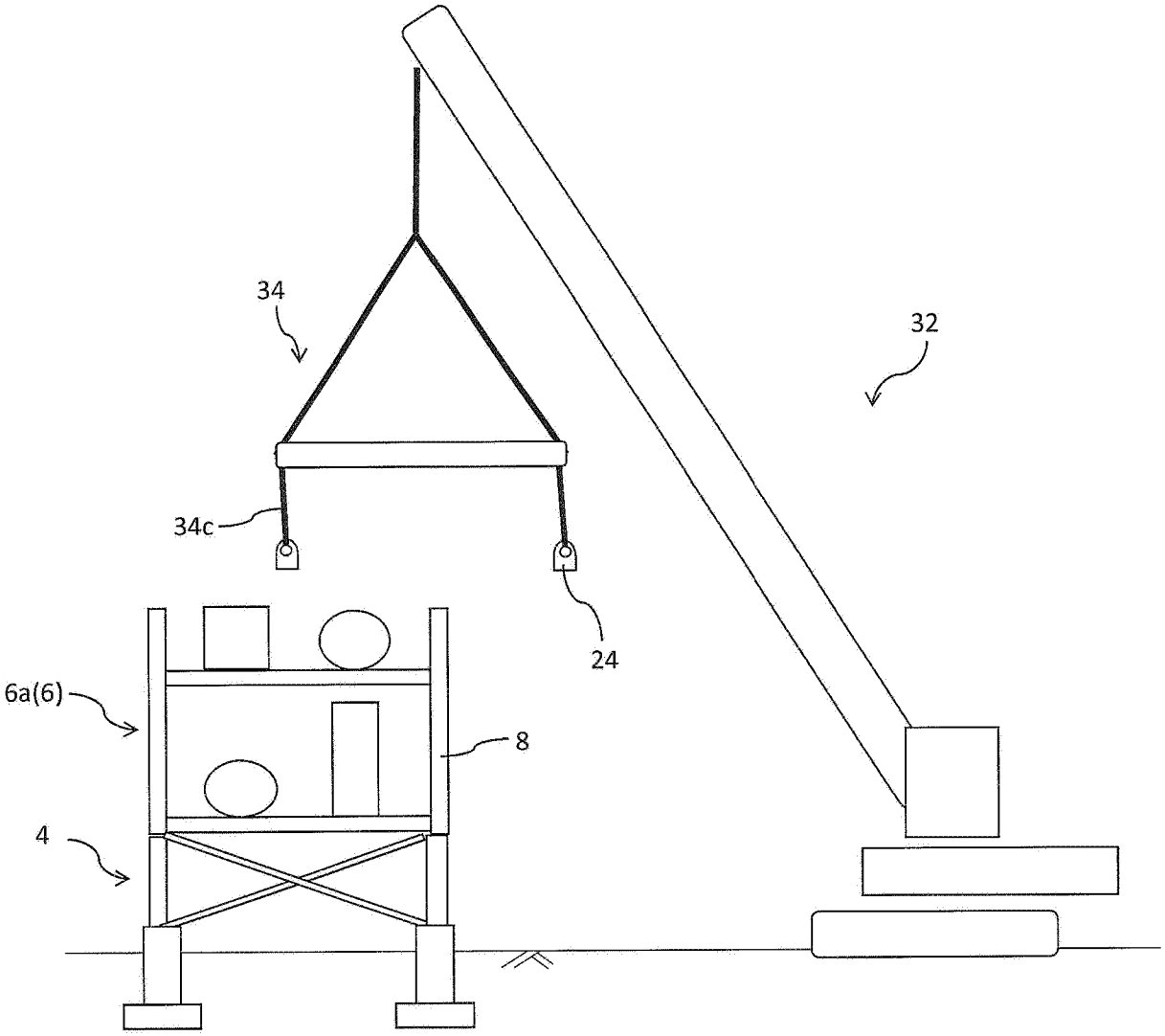
FIG. 9 is a view for illustrating a state in which the lifting components are removed from a first module for separate conveyance in the process of constructing the structure for a plant according to the embodiment.

Next, the high-strength bolts 28 are removed from the lifting components 24 mounted to the column portions 8 of the first module 6*a* for separate conveyance to separate the lifting components 24 from the column portions 8, as illustrated in FIG. 9. In this case, the lifting components 24 are moved together with the spreader beam 34 while being suspended from the holder wires 34*c*.

Next, the heavy machine 32 is operated to move the spreader beam 34 to the yard 19 again, and the lifting components 24 suspended from the holder wires 34*c* are mounted to the second module 6*b* for separate conveyance, which is placed on the yard 19. The lifting components 24 are mounted in the same manner as in the case of the first module 6*a* for separate conveyance, which has been described with reference to FIG. 4.

Figure 10:
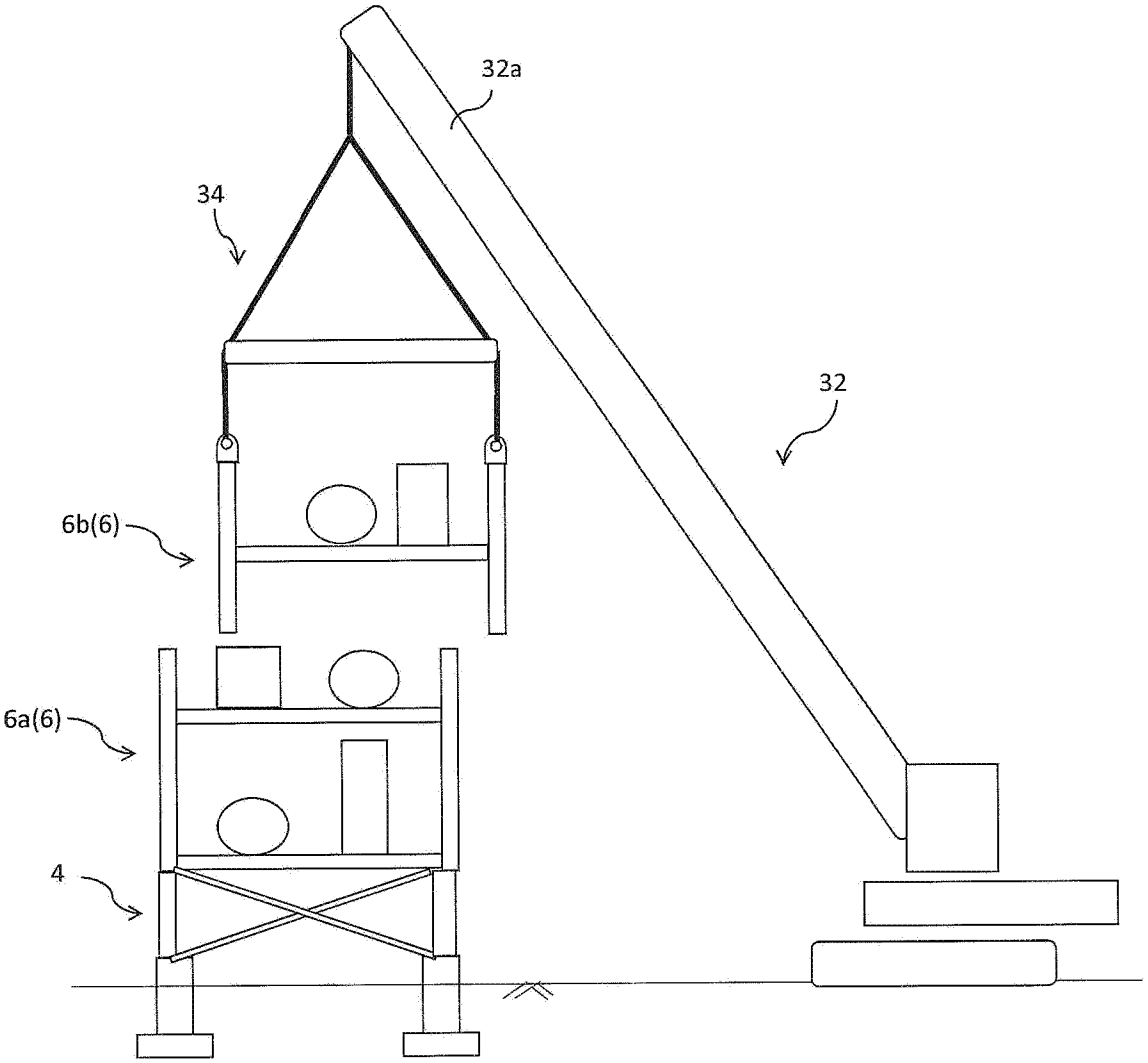
FIG. 10 is a view for illustrating a situation in which a second module for separate conveyance is stacked in the process of constructing the structure for a plant according to the embodiment.
Figure 11:
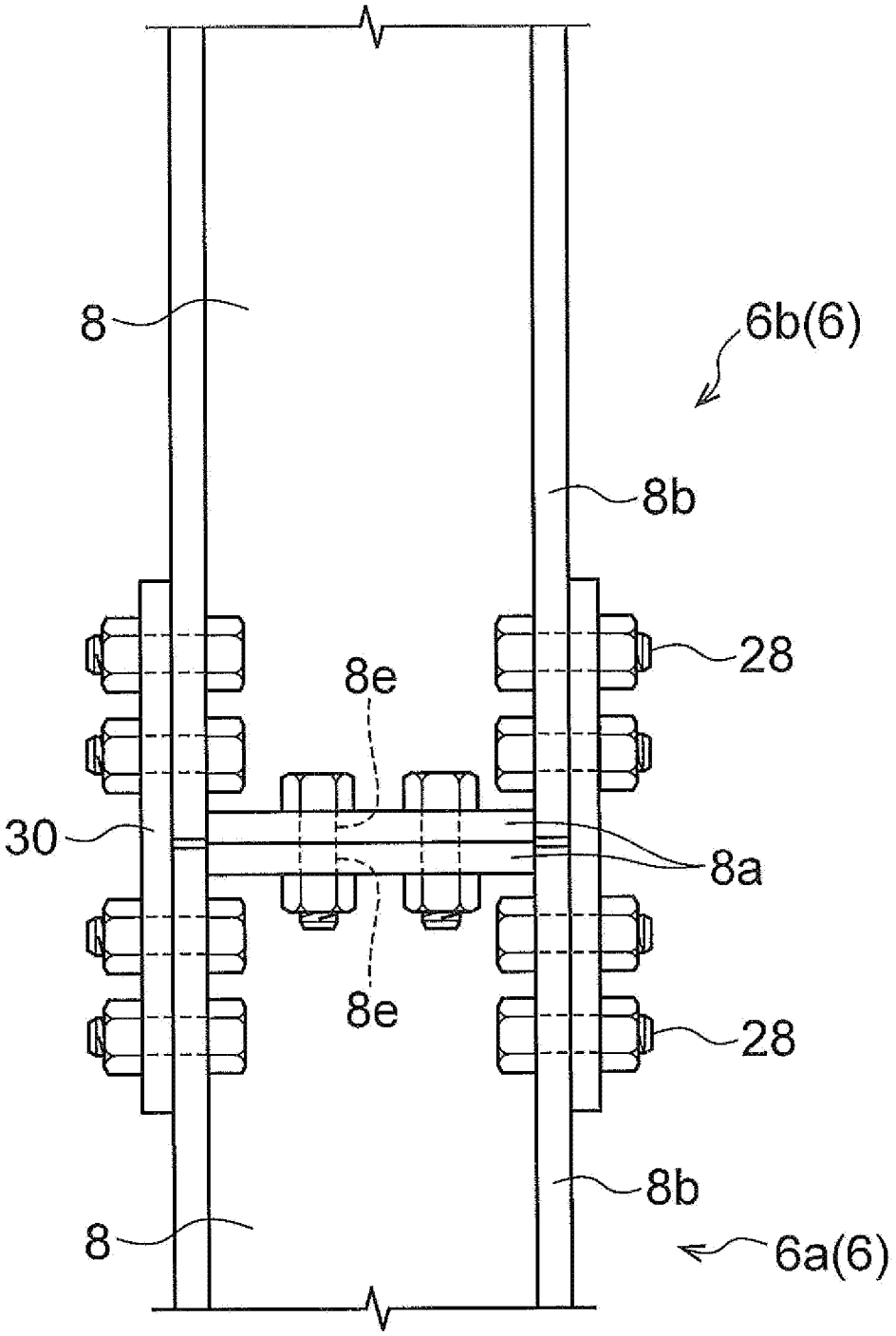
FIG. 11 is a view for illustrating a joint portion between the column portions in the structure for a plant according to the embodiment.

Next, as illustrated in FIG. 10, the arm 32*a* is moved to a position above the first module 6*a* for separate conveyance under a state in which the second module 6*b* for separate conveyance is suspended therefrom. Then, as illustrated in FIG. 11, the positions of the lower ends of all the column portions 8 included in the second module 6*b* for separate conveyance are aligned with positions of the upper ends of the column portions 8 of the first module 6*a* for separate conveyance. When the second module 6*b* for separate conveyance is mounted onto the first module 6*a* for separate conveyance, the upper horizontal plate 8*a* is first superposed on the lower horizontal plate 8*a* while the positions of the bolt holes 8*e* thereof are aligned with each other. After that, the horizontal plates 8*a* are connected to each other with use of the high-strength bolts 28.

Further, the splice plates 30 are arranged so as to partially cover the flanges 8*b* of the upper and lower column portions 8, and the upper and lower flanges 8*b* and the splice plate 30 are connected to each other with use of the high-strength bolts 28. The bolt holes are formed in each of the flanges 8*b* of the upper and lower column portions 8 and the splice plate 30. The splice plates 30 are brought into contact with the flanges 8*b* while positions of the bolt holes are aligned with each other.

As described above, with use of the splice plate 30, the column portions 8 can be joined to each other so that a moment is precisely transmitted through a joint between the column portions 8. The horizontal plates 8*a* are connected to each other with use of the high-strength bolts 28. Further, the splice plate 30 is arranged so as to partially cover the flanges 8*b* of the upper and lower column portions 8. As a result, the column portions 8 of the second module 6*b* for separate conveyance are rigidly joined onto the column portions 8 of the first module 6*a* for separate conveyance.

Figure 12:
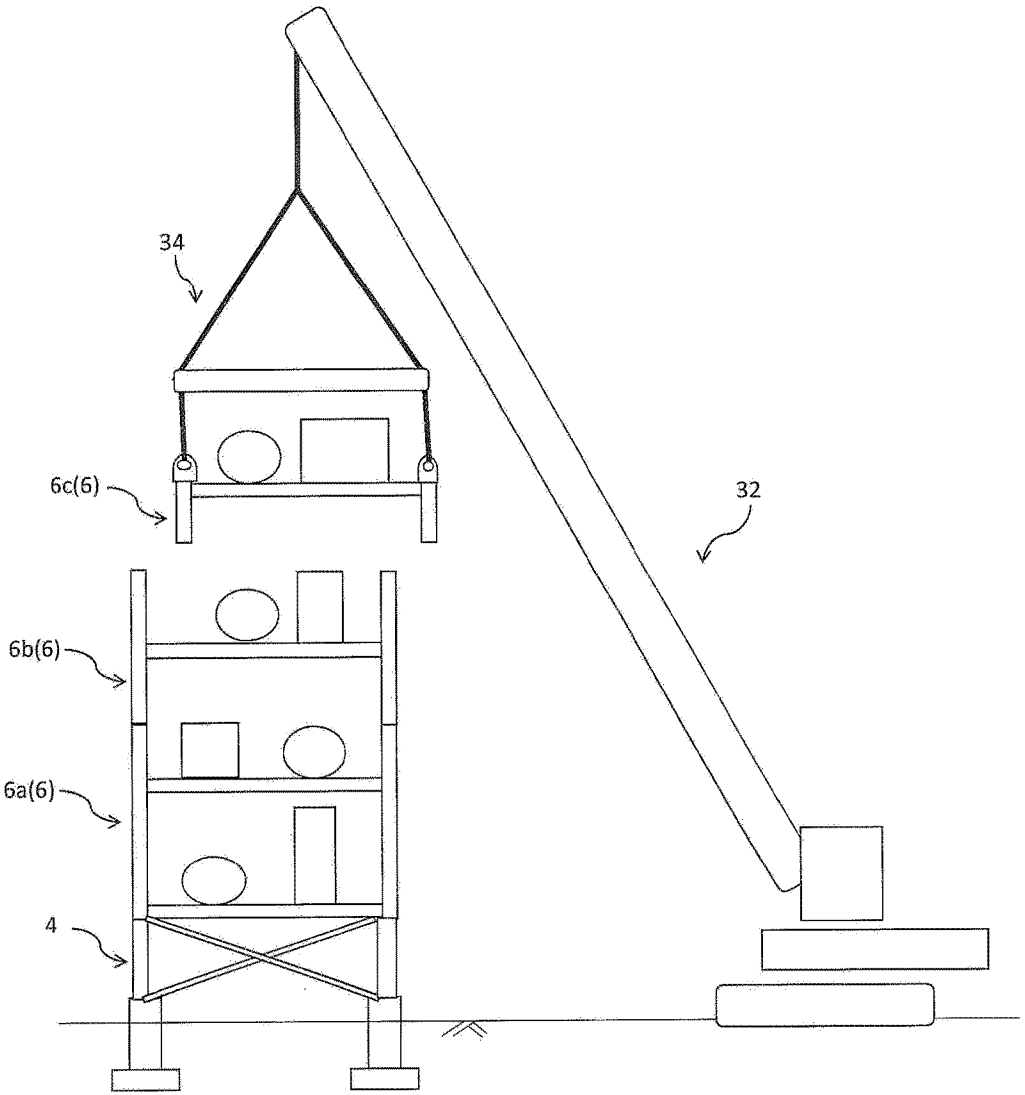
FIG. 12 is a view for illustrating a situation in which a third module for separate conveyance is stacked in the process of constructing the structure for a plant according to the embodiment.

After the second module 6*b* for separate conveyance is stacked, the third module 6*c* for separate conveyance is further stacked on the second module 6*b* for separate conveyance, as illustrated in FIG. 12. The mounting of the lifting components 24 and the joining between the upper and lower column portions 8 are performed in the same manner as in the case in which the second module 6*b* for separate conveyance is mounted onto the first module 6*a* for separate conveyance. In this case, when the stacking of the third module 6*c* for separate conveyance is completed for all the frames that are present in a depth direction, the structure 2 for a plant is completed. After the work, the lifting components 24 are collected for reuse.

With the module 6 for separate conveyance in this embodiment, the horizontal structural portions 10 directly separate the tier spaces 12 that are adjacent to each other in the up-and-down direction when the modules 6 for separate conveyance are stacked. Thus, a total height of the modules 6 for separate conveyance is reduced, and a total weight can be reduced. Thus, a module for separate conveyance, which is inexpensive and can easily be conveyed via any route, can be provided.

Further, at least one of the upper end and the lower end of each of the column portions 8 forms the free end 9 that is not joined to the horizontal structural portion 10. The height position of each of the free ends 9 is apart from the height position of the boundary between the tier spaces 12 under a stacked state. Thus, a part of a horizontal structural portion, which is required in the related-art box-type module structure 106, can be omitted. Thus, the number of steel frames can be reduced, and manufacturing cost can be suppressed.

Further, the lifting components 24, the column portions 8, and the base columns 4*a* are joined with use of the high-strength bolts 28. Thus, in comparison to a case in which the connection is achieved by welding, assembly work for the modules for separate conveyance at the site can be minimized, and hence safety and a working speed can be improved.

Figure 13:
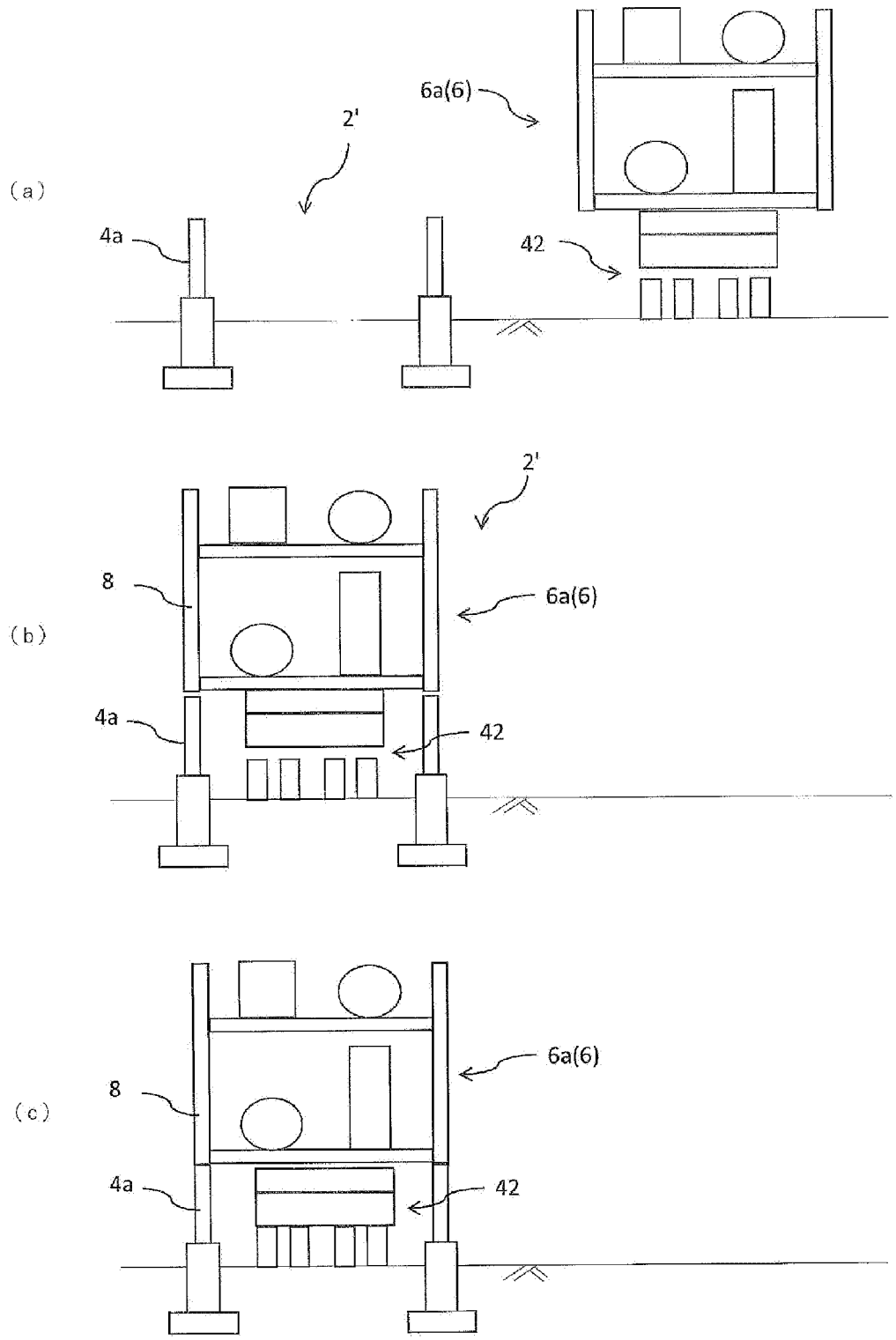
FIG. 13 are views for illustrating a situation in which the first module for separate conveyance is stacked on the base columns in the process of constructing the structure for a plant with use of an SPMT according to another embodiment.

Further, in the embodiment described above, when the first module 6*a* for separate conveyance is installed on the base columns 4*a*, it is not always required that the spreader beam 34 be used. For example, as illustrated in FIG. 13, a self-propelled trolley such as a self-propelled modular transport (SPMT) having a lift up-and-down function may be used. In this case, for example, when the structure 2 for a plant is constructed in the country B, the modules 6 for separate conveyance, which have been unloaded from a container vessel, are loaded on SPMTs 42.

Next, the modules 6 for separate conveyance, which are loaded on the SPMTs 42, are transported by land to the construction site for the structure 2 for a plant for the petroleum refinery processing plant. In this case, the SPMT 42 on which the second module 6*b* for separate conveyance is loaded and the SPMT 42 on which the third module 6*c* for separate conveyance is loaded wait in the vicinity of the construction site.

Meanwhile, for the first module 6*a* for separate conveyance, installation work is directly performed. Specifically, as illustrated in FIG. 13(*a*), the SPMT 42 on which the first module 6*a* for separate conveyance is loaded approaches a structure 2' for a plant, which is being constructed, and, as illustrated in FIG. 13(*b*), directly moves into the structure 2' for a plant, which is being constructed.

Next, after positional alignment between the column portions 8 and the base columns 4*a* on a horizontal plane, as illustrated in FIG. 13(*c*), the first module 6*a* for separate conveyance is lowered by the lifting function of the SPMT 42 to be installed on the base columns 4*a*. The column portions 8 are connected to the base columns 4*a* with use of the high-strength bolts 28 in the same manner as that described with reference to FIG. 6. The first module 6 for separate conveyance is installed on the base columns 4*a* without the braces 36 mounted therebetween yet. Thus, it is preferred that the column portions 8 be connected to the base columns 4*a* by the rigid jointing (see FIG. 11) with use of the horizontal plates 8*a* in consideration of stability.

Figure 14:
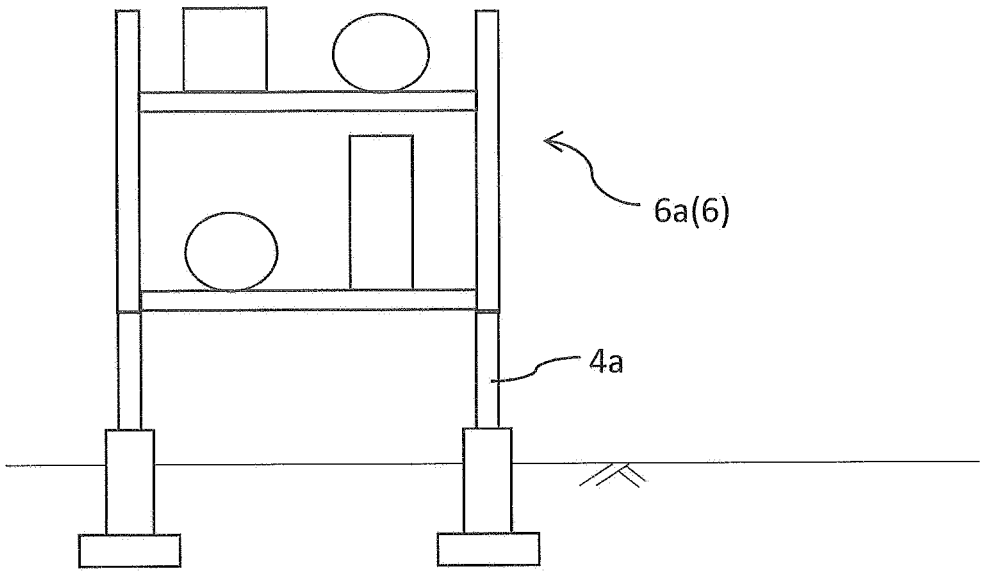
FIG. 14 are views for illustrating a situation in which the braces are mounted between the base columns in the process of constructing the structure for a plant with use of the SPMT according to the another embodiment.
Figure 14:
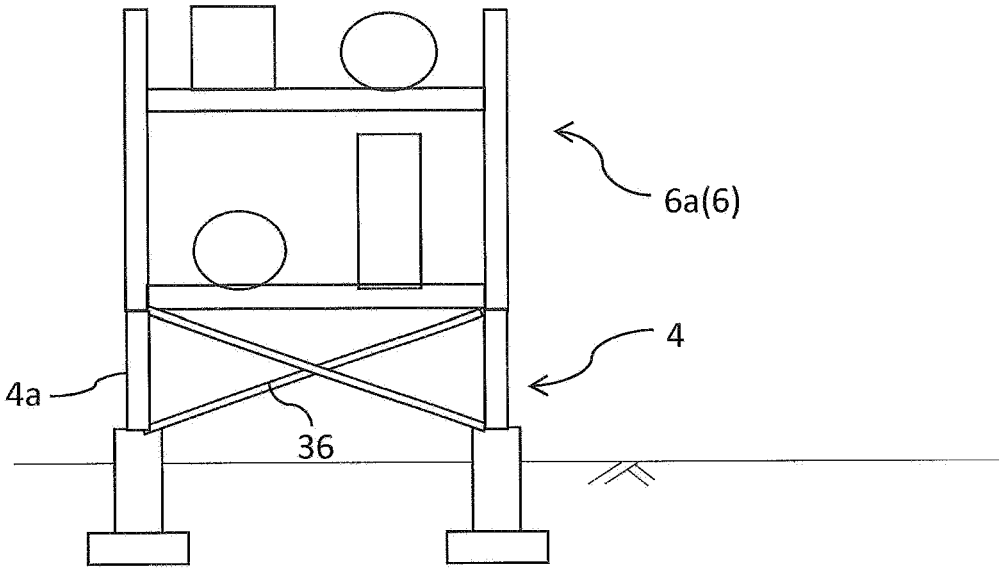

After the installation work for the first module 6*a* for separate conveyance is completed, the SPMT 42 is caused to exit from the structure 2' for a plant, which is being constructed, as illustrated in FIG. 14(*a*). After that, as illustrated in FIG. 14(*b*), the braces 36 are mounted in the X-like pattern between the base columns 4*a*. It is apparent that the compressive braces 36' may be used in place of the braces 36 (see FIG. 8(*b*)). Next, the second module 6*b* for separate conveyance and the third module 6*c* for separate conveyance are suspended with use of the heavy machine 32 to be installed as in the case described with reference to FIG. 10 to FIG. 12.

When the SPMTs 42 are used, it is not always required that the above-mentioned procedure be employed. For example, the modules 6 for separate conveyance, which have been unloaded at a port, may be first conveyed to the construction site by the transport means such as a truck, and then reloaded on the SPMTs 42. At this time, the reloading may be performed with use of the heavy machine 32.

Further, in the embodiment described above, three kinds of the modules 6 for separate conveyance, specifically, the first module 6*a* for separate conveyance, the second module 6*b* for separate conveyance, and the third module 6*c* for separate conveyance, have been described as examples of the modules 6 for separate conveyance. However, the number and the number of kinds of the modules 6 for separate conveyance, which are included in one structure 2 for a plant, are not limited to those described above. For example, a fourth module for separate conveyance may be used.

Further, in the embodiment described above, the base columns may project downward beyond the horizontal structural portions 10 located on the lower side of the first module 6*a* for separate conveyance. In this case, a maximum height of the first module 6*a* for separate conveyance is suppressed so as to fall within a range of from 3 m or more to 20 m or less, and the projection of the base columns is required to be minimized.

Further, in the embodiment described above, the high-strength bolts 28 are used as members configured to join, for example, the plates. For example, a frictional joint other than the high-strength bolt 28, such as a rivet, may be used.

The invention claimed is:

1. A module for separate conveyance, to be conveyed in a separate manner and stacked at a construction site, the module for separate conveyance comprising:

column portions to be provided upright in a vertical direction; and a horizontal structural portion to be provided in a horizontal direction between the column portions, wherein each of the column portions is formed of an H-shaped steel member, comprising:

a horizontal plate, flange portions and a web;

wherein in a region of the horizontal plate which is located between the flange portions, bolt holes are provided such that the web is positioned between the bolt holes, wherein the horizontal structural portion directly separates tier spaces adjacent to each other in an up-and-down direction when the modules for separate conveyance are stacked, wherein the horizontal plate having the bolt holes is provided to each end of each of the column portions, and the horizontal plate is disposed on inner surfaces of the flange portions of each of the column portions, wherein the ends of the upper and lower column portions are joined to each other in the up-and-down direction by aligning the bolt holes of the horizontal plates and connecting the horizontal plates to each other with bolts and the bolt holes, wherein a first splice plate is disposed on an outer surface of one of the flange portions and a second splice plate is disposed on an outer surface of another of the flange portion, the first splice plate and the second splice plate are arranged over a joint between the ends of the upper and lower column portions to partially cover upper and lower flange portions, and wherein the upper and lower flange portions and the splice plate are joined to each other with the bolts, wherein the horizontal plate extends from the one of the flange portions to the another of the flange portions, and wherein the horizontal plate extends to both sides of the web.

2. The module for separate conveyance according to claim 1, wherein at least one of an upper end and a lower end of each of the column portions is a free end that is not joined to the horizontal structural portion, and a height position of the free end is apart from a height position of a boundary between the tier spaces.

3. The module for separate conveyance according to claim 1, wherein the module for separate conveyance, which is to be arranged in a lowermost tier when the modules for separate conveyance are stacked, lacks base columns projecting downward beyond the horizontal structural portion located on a lowermost side.

4. The module for separate conveyance according to claim 1, wherein a height of the module for separate conveyance under a state in which a device is installed falls within a range of from 3 m or more to 20 m or less at time of conveyance.

5. A structure for a plant, to be constructed by stacking the modules for separate conveyance of claim 1, wherein a height of the structure for a plant under a state in which devices are installed falls within a range of from 5 m or more to 25 m or less.

6. A method of constructing the structure for a plant of claim 1, comprising:

a mounting step of mounting lifting components to upper ends of the column portions; and an installation step of installing the module for separate conveyance while simultaneously lifting up all the column portions through intermediation of the lifting components.

7. The method of constructing the structure for a plant according to claim 6, further comprising:

a base-column upright installation step of installing base columns upright in a vertical direction on foundations; and a brace mounting step of mounting base portion braces in a crossing pattern between the base columns.

8. The module for separate conveyance according to claim 2, wherein the module for separate conveyance, which is to be arranged in a lowermost tier when the modules for separate conveyance are stacked, lacks base columns projecting downward beyond the horizontal structural portion located on a lowermost side.

9. The module for separate conveyance according to claim 2, wherein a height of the module for separate conveyance under a state in which a device is installed falls within a range of from 3 m or more to 20 m or less at time of conveyance.

10. The module for separate conveyance according to claim 3, wherein a height of the module for separate conveyance under a state in which a device is installed falls within a range of from 3 m or more to 20 m or less at time of conveyance.

* * * * *